United States Patent [19]

Avery

[11] 4,128,063

[45] Dec. 5, 1978

[54] STOOL

[76] Inventor: Hillard M. Avery, R.R. 3, Box 140A, Morgantown, Ind. 46160

[21] Appl. No.: 835,059

[22] Filed: Sep. 21, 1977

[51] Int. Cl.[2] ..... A47B 7/00

[52] U.S. Cl. ..... 108/91; 108/153; 108/157; 248/165

[58] Field of Search ..... 108/91, 153, 157; 248/165, 188

[56] References Cited

U.S. PATENT DOCUMENTS

| | | | |
|---|---|---|---|
| 1,639,318 | 8/1927 | Viewegh | 108/91 X |
| 2,210,047 | 8/1940 | Stieglitz | 248/165 |
| 2,369,930 | 2/1945 | Wagner | 248/188 |
| 4,064,993 | 12/1977 | Getner | 248/165 X |

FOREIGN PATENT DOCUMENTS

| | | | |
|---|---|---|---|
| 786497 | 11/1957 | United Kingdom | 108/157 |
| 871903 | 7/1961 | United Kingdom | 108/91 |

*Primary Examiner*—James C. Mitchell
*Attorney, Agent, or Firm*—Jenkins, Coffey & Hyland

[57] ABSTRACT

A stand or stool includes a top providing an upwardly facing supporting surface and a downwardly facing surface including a plurality of locking channels. The stand or stool includes a plurality of legs, each leg having a top portion for engagement in a respective locking channel on the downwardly facing surface of the top, and a foot portion for resting on a floor or article of furniture. The legs are readily disengageable from the top by sliding the leg top portions from the locking channels, making the stand collapsible. The stand includes a brace which is generally ring-like and sized to slide downwardly over the top and legs. A locking protrusion is provided on the outer edge of each leg for engaging a respective pocket provided on the brace to lock the legs in spaced-apart relation to one another. In the illustrated embodiment, the locking channels extend generally radially from the center of the top. Each leg includes an inner edge which is provided with a stacking support. The stacking supports permit vertical stacking of stands, each stand in a vertical stack receiving the top of the next subjacent stand in the stack in nested orientation.

10 Claims, 6 Drawing Figures

STOOL

This invention relates to stools or stands, and particularly to a collapsible stool or stand.

It is an object of the present invention to provide a simple, sturdy and attractive collapsible stand for use as, for example, a plant stand or a camp or boat stool.

According to the present invention, a supporting stand comprises a top providing an upwardly facing supporting surface and a downwardly facing surface providing a plurality of locking channels. The stand includes a plurality of legs, each leg having a top portion for engagement with a respective locking channel on the downwardly facing surface of the top, and a front portion for resting on a floor, the ground or other surface. The legs are readily disengageable from the locking channels without the use of tools or special equipment to render the stand collapsible.

According to an illustrative embodiment, the stand further includes a brace and a locking protrusion on each of the legs for engaging the brace to lock the legs in spaced-apart relation to one another. The locking protrusion on each leg is located intermediate the top portion and foot of the leg. The brace is generally ring-like in configuration.

Further according to an illustrative embodiment, the locking channels extend generally radially from approximately the center of the top.

Additionally according to the illustrated embodiment, each leg includes a radially outer edge and a radially inner edge, the leg radially outer edges extending generally perpendicular to the stand support means surface. The locking protrusion on each leg is located on the outer edge thereof, and the brace is slidable downwardly over the top of the stand and along the leg outer edge into engagement with the locking protrusions.

Further according to the illustrative embodiment, the radially inner edge of each leg includes a stacking support portion allowing the stands to be vertically stacked one upon another. Each stand in a vertical stack of such stands receives the next subjacent stand in the stack in nested orientation. The top of the next subjacent stand engages the stacking supports of the legs of the next superjacent stand to support it.

The invention may best be understood by referring to the following description and accompanying drawings which illustrate the invention. In the drawings.

Figure 1:
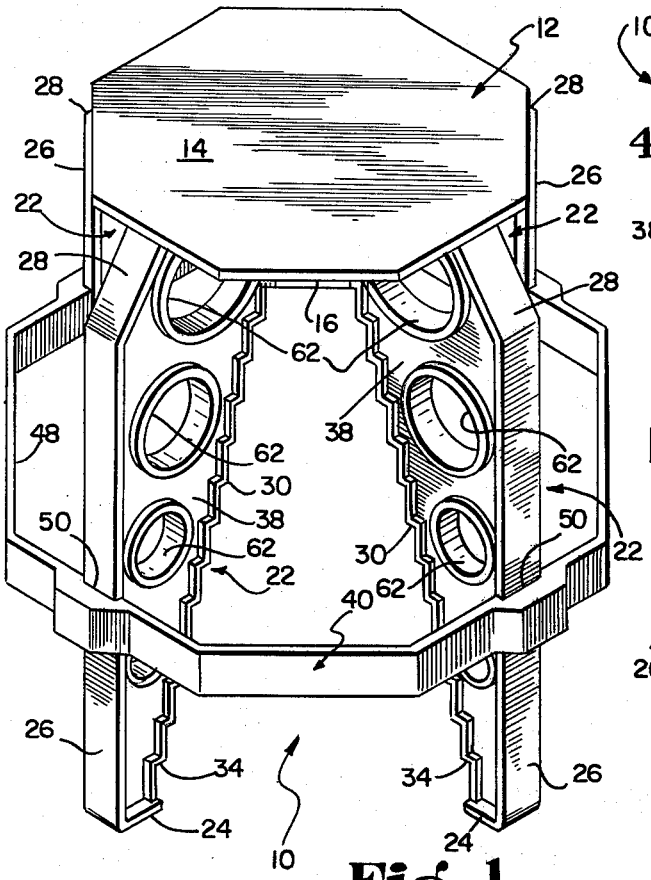
FIG. 1 is a perspective view of a collapsible supporting stand or tool constructed according to the present invention.
Figure 2:
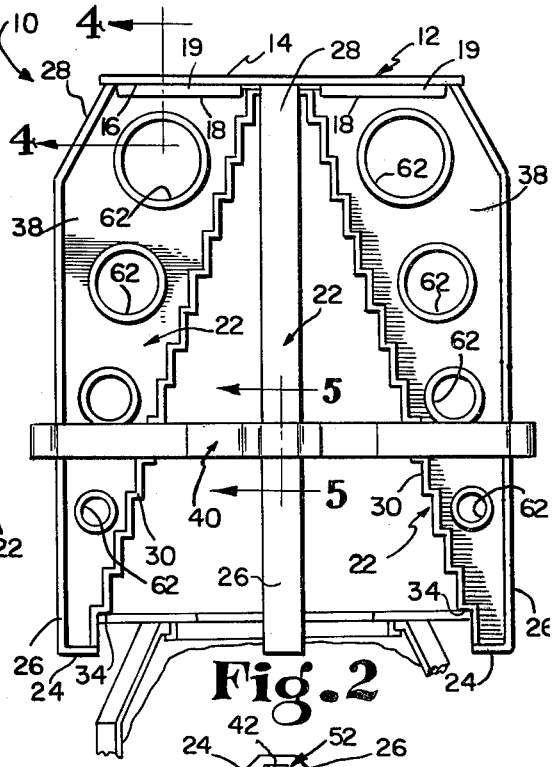
FIG. 2 is a side elevational view of the device of FIG. 1 with the top of a subjacent stand in a nested stack of such stands illustrated fragmentarily.
Figure 3:
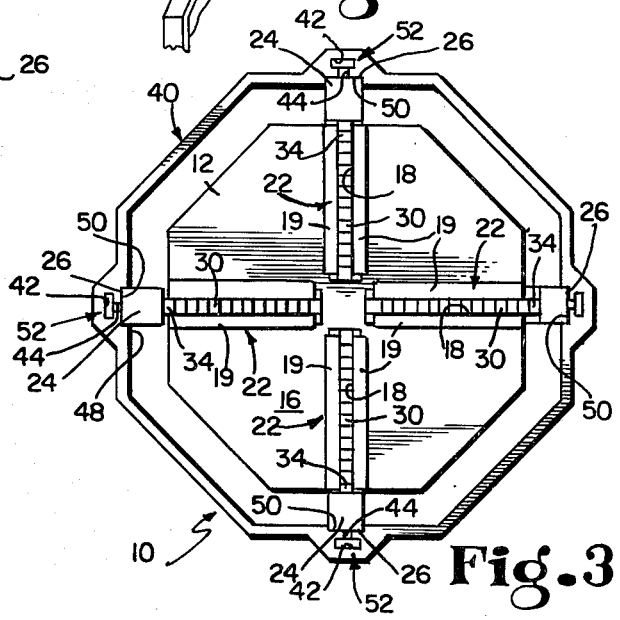
FIG. 3 is a bottom plan view of the device of FIGS. 1–2.
Figure 4:
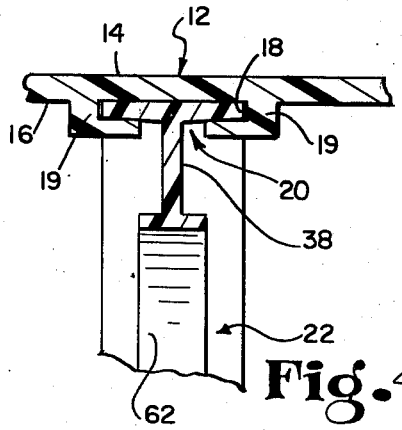
FIG. 4 is a fragmentary sectional view of the device of FIGS. 1–3, taken generally along section lines 4–4 of FIG. 2.

Referring now particularly to FIGS. 1–3, a collapsible stand or stool 10 includes a top portion 12 providing an upwardly facing top supporting surface 14 and a downwardly facing surface 16. Downwardly facing surface 16 provides a plurality of locking channels 18 (see FIG. 4) for slidably receiving the top portions 20 of an equal plurality of legs 22. Locking channels 18 freely slidably engage tops 20, which equally freely are disengageable therefrom by movement of the legs 22 generally radially outwardly from the center of top 12 in locking channels 18. As can best be seen from FIG. 4, the top portion 20 of each leg 22 has a generally T-shaped cross section, the top bar of the "T" being slidable into the channel 18. Each channel 18 is formed from two inwardly opening, facing, generally L-shaped protrusions 19 on the downwardly facing surface 16 of top 12.

Each leg 22 includes a supporting foot portion 24 for resting upon a floor, an article of furniture, the ground or other supporting surface. Each leg 22 includes a generally flat and smooth radially outer edge 26 which extends generally vertically to a point slightly below top 12, and then tapers upwardly and inwardly, as indicated at 28 to downwardly facing surface 16. Each leg 22 further includes a serrated or stringer-like inner edge 30. These inner edges 30 are generally decorative, but each provides a functional supporting surface 34 adjacent its respective foot 24. Supporting surfaces 34 extend radially outwardly beyond the outer edge 36 of top 12. This arrangement provides for nested, upright vertical stacking of stands 10, each stand 10 in a vertical stack of stands receiving the top 12 portion of the next subjacent stand 10, the top surface 14 of such next subjacent stand 10 supporting the superjacent stand 10 by engagement of the top surface 14 of the subjacent stand with the supporting surfaces 34 on the inner edges 30 of legs 22 of the superjacent stand, as illustrated fragmentarily in FIG. 2.

Figure 5:
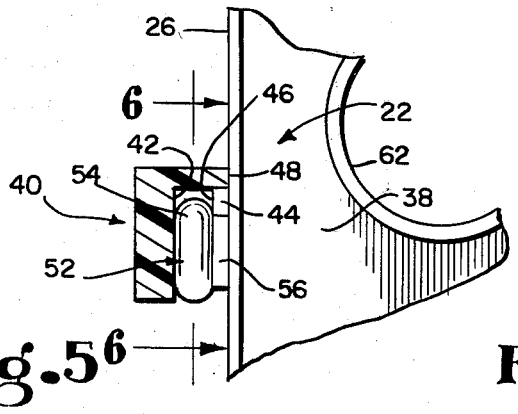
FIG. 5 is a fragmentary sectional view of the device of FIGS. 1–3, taken generally along section lines 5—5 of FIG. 2; and, FIG. 6 is a fragmentary sectional view of the device of FIGS. 1–3, taken generally along section lines 6—6 of FIG. 5.
Figure 6:
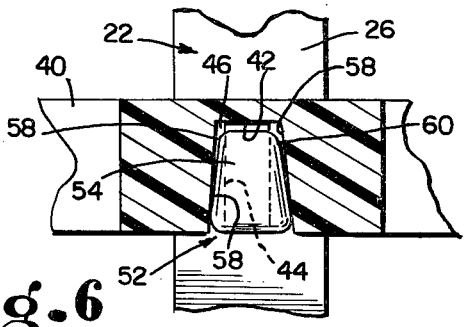

The tops 20 of legs 22 are maintained in spaced-apart relationship by engagement in their respective locking channels 18. Some strengthening and reinforcement of each leg 22 is provided by the outer and inner edges 26, 30 thereof, these edges being substantially thicker than the web, or intermediate portion, 38 of each leg 22. Further to insure that the stand or stool 10 will easily support considerable weight, e.g., the weight of an individual, the stand 10 is equipped with a ring-like brace 40 which, in the illustrated embodiment, is provided with a number of downwardly opening pockets 42. The number of pockets 42 is equal to the number of legs 22. A communicating slot 44 is provided between the radially inner side 46 (FIGS. 5–6) of each pocket 42 and the radially inner surface 48 of brace 40. The radially inner surface of brace 40 is further provided with an indentation 50 (FIGS. 1, 3) around the opening of each slot 44 in the inner surface 48, indentations 50 slidably engaging the outer edges 26 of legs 22.

The outer edge 26 of each leg 22 further includes a projection 52 (FIGS. 3, 5, 6) for engaging each pocket 42. Each projection 52 includes an enlarged head portion 54 (FIGS. 5, 6) received in a respective pocket 42, and a stem portion 56 (FIG. 5) which slidably enters each slot 44. Brace 40 is held downwardly upon projections 52 by gravity and friction. The side walls 58 (FIG. 6) of each pocket 42 taper upwardly and inwardly, as do the sides 60 of each head 54 to facilitate removal of brace 40 from legs 22.

It should be appreciated that this structure permits easy assembly and disassembly of a stand or stool 10, as well as providing the necessary strength and rigidity for such stand or stool to support a load. Of course, no tools or special equipment are required to assembly or disassemble such a stand or stool 10. Further, the stand or stool 10, when collapsed or "knocked-down" can readily be shipped, since it forms a flat package. In its knocked-down configuration, all four legs can be laid substantially flat. Brace 40 can thus be laid on top of the legs 22 and top 12 can be placed within the interior of brace 40, also resting upon legs 22.

A plurality of openings 62 (FIGS. 1, 2, 4, 5) are formed in each web 38 to lighten the legs 22, and decrease the amount of material necessary to mold legs 22. Typically, the entire stand 10 will be molded from a high-impact plastic material. In one embodiment, the stand 10 is molded from LEXAN ® polycarbonate plastic.

What is claimed is:

1. A supporting stand comprising a top providing an upwardly facing supporting surface and a downwardly facing surface providing a plurality of channels, and a plurality of legs, each leg having a top portion for engagement with a respective channel on the downwardly facing surface, the legs being readily disengageable from the top to render the stand collapsible, each leg further including a central web-like portion surrounded by a reinforcing flange portion providing said top portion, a supporting foot portion which is parallel with the leg top portion, a generally flat radially outer edge which extends generally perpendicularly from its said foot portion toward said leg top portion to a distance between the leg foot portion and top portion, and then tapers upwardly and inwardly toward the leg top portion.

2. The apparatus of claim 1 and further comprising a brace and a protrusion on each leg for engaging the brace for holding the legs in spaced-apart relation to one another, the protrusion on each leg being located intermediate the top portion and foot thereof, the brace holding the intermediate portions of the legs in spaced-apart relation.

3. The apparatus of claim 2 wherein the brace is generally ring-like.

4. The apparatus of claim 3 wherein the channels extend generally radially from substantially the center of the top.

5. A supporting stand comprising a top providing an upwardly facing supporting surface and a downwardly facing surface providing a plurality of channels extending generally radially from substantially the center of the top, and a plurality of legs, each leg having a top portion for engagement with a respective channel on the downwardly facing surface and a foot portion, the legs being readily disengageable from the top to render the stand collapsible, a ring-like brace, a protrusion on each leg for engaging the brace for holding the legs in spaced-apart relation to one another, the protrusion on each leg being located intermediate the top portion and foot thereof, the brace holding the intermediate portions of the legs in spaced-apart relation, each leg including a leg outer edge and a leg inner edge, the leg outer edges extending generally perpendicular to the top, the protrusion on each leg being located on the outer edge thereof, the brace being slidable downwardly over the top of the stand and downwardly along the leg outer edges into engagement with the protrusions.

6. The apparatus of claim 5 wherein a vertical stack of such stands is provided, the radially inner edge of each leg being provided with a stacking portion, the stacking portions of the legs of one stand being spaced apart to engage the top of the next subjacent stand.

7. The apparatus of claim 1 wherein the top of each leg comprises a generally T-shaped portion and the channel for receiving the top portion of a respective leg including a pair of facing, generally L-shaped elongated protrusions on the downwardly facing surface, the facing L-shaped protrusions receiving the top bar of the generally T-shaped leg top portion.

8. A stand comprising a top providing an upwardly facing supporting surface and a downwardly facing surface, a plurality of channels provided in the downwardly facing surface, a plurality of legs, each leg including an upper portion for engaging a respective channel to support the top and a supporting foot portion, the leg upper portions slidably engaging the channels and being disengageable therefrom to render the stand or stool collapsible, the channels being generally radially disposed about a point on the downwardly facing surface, each leg further having a generally radially inner edge and a generally radially outer edge, each leg further including a central web-like portion bounded by the upper portion, radially inner and outer portions, and supporting foot portion, the radially outer edge of each leg including a projection disposed intermediate the top and foot thereof, the stand further including a brace for maintaining the orientations of the legs with respect to the top, the brace being ring-like and slidable vertically downwardly over the top and along the outer edges of the legs, the brace including a plurality of pockets equal to the number of projections for receiving the projections to retain the brace in position intermediate the tops and feet of the legs.

9. The apparatus of claim 8 wherein each pocket opens downwardly and includes a pair of opposed upwardly and inwardly tapering walls and each projection includes a pair of cooperating generally correspondingly tapered walls for abutting the tapered walls of a respective pocket, the cooperating tapered walls of the pockets and projections facilitating removal of the brace from the legs.

10. The apparatus of claim 8 wherein the radially inner edge of each leg includes a stacking support, each stand in a vertical stack of such stands receiving the next subjacent stand in the stack in nested orientation, the top of the next subjacent stand resting against the stacking supports of the legs of its next superjacent stand to support it.

* * * * *